United States Patent [19]

Ichikawa

[11] Patent Number: 4,788,568

[45] Date of Patent: Nov. 29, 1988

[54] IMAGE RECORDING APPARATUS

[75] Inventor: Shin-ichi Ichikawa, Kanagawa, Japan

[73] Assignee: Fuji Photo Film Co., Ltd., Kanagawa, Japan

[21] Appl. No.: 74,818

[22] Filed: Jul. 17, 1987

[30] Foreign Application Priority Data

Jul. 17, 1986 [JP] Japan ..... 61-168929

[51] Int. Cl.[4] ..... G03D 5/06

[52] U.S. Cl. ..... 354/303; 354/305; 354/318

[58] Field of Search ..... 354/301, 303, 305, 317, 354/318; 403/203, 403; 118/244, 246, 248, DIG. 15

[56] References Cited

U.S. PATENT DOCUMENTS

| | | | |
|---|---|---|---|
| 2,051,222 | 8/1936 | Odell | 118/DIG. 15 |
| 2,241,104 | 5/1941 | Van Der Grinten | 354/318 |
| 2,605,684 | 8/1952 | Nagels et al. | 354/318 |
| 3,552,292 | 1/1971 | Gold | 118/246 |
| 3,943,541 | 3/1976 | Hurafuji | 354/318 |
| 4,106,433 | 8/1978 | Fernando et al. | 118/246 |

FOREIGN PATENT DOCUMENTS 59-75247 4/1984 Japan .

*Primary Examiner*—A. A. Mathews

*Attorney, Agent, or Firm*—Sughrue, Mion, Zinn, Macpeak, and Seas

[57] ABSTRACT

An image recording apparatus which forms an image on an image receiving medium by transferring an image recorded on a heat-developable photosensitive medium in the presence of an image forming solvent, the apparatus having an application roller which is partly immersed in the solvent and which functions, while rotating, to apply this solvent to the heat-developable medium or the image receiving medium. Grooves are provided on the application roller in the vicinity of the axial ends thereof. The image forming solvent is thereby uniformly attached to the outer periphery of the application roller, and this solvent is then uniformly applied to the heat-development medium or the image receiving medium.

8 Claims, 3 Drawing Sheets

IMAGE RECORDING APPARATUS

BACKGROUND OF THE INVENTION

This invention relates to an image recording apparatus which forms an image on an image receiving medium by transferring an image recorded on a heat-developable photosensitive medium in the presence of an image forming solvent.

A known type of image recording apparatus for forming color images by using a heat-developable photosensitive medium, such as that disclosed in Japanese Patent Laid-Open No. 75247/1984, involves a transfer and development process in which a heat-developable medium which has been exposed to an image is transported to a thermal development section, a sheet of image receiving paper is brought into close contact with the photosensitive medium that has been heat-developed, and the image is then transferred to the image receiving paper.

To improve the transfer efficiency, a transfer assistant (image forming solvent) such as water is previously applied to the image receiving paper before this paper is transported to the transfer section.

In the apparatus disclosed in the above-mentioned Japanese Laid-Open No. 75247/1984, water is applied to the paper for this purpose by being lifted by a roller from a liquid bath.

If water is applied by using an application roller, a quantity of water attached to the surface of the roller tends to move inward to an intermediate portion of the roller by the effect of surface tension, and there is therefore no substantial quantity of water attached to the roller in the vicinity of its two ends. If the roller is used to apply water under this condition, no water is applied to the widthwise ends of the image receiving paper which faces the roller. It is therefore difficult to apply water uniformly.

The present invention has been achieved in the light of the above-described facts, and an object of the present invention is to provide an image recording apparatus capable of uniformly applying an image forming assistant such as water to a heat-developable photosensitive medium or an image receiving medium by enabling uniform attachment of an image forming assistant such as water to the outer periphery of an application roller.

SUMMARY OF THE INVENTION

To this end, the present invention provides an image recording apparatus which forms an image on an image receiving medium by transferring an image recorded on a heat-developable photosensitive medium in the presence of an image forming solvent, the apparatus having: a tank for storing the solvent; a roller means disposed in the tank and adapted for applying the solvent to the heat-developable photosensitive medium or the image receiving medium by rotating in correspondence with the movement of the heat-developable photosensitive medium or the image receiving medium; and retaining means for making a part of the solvent stay on the roller, the retaining means being provided on the outer peripheries of portions of the roller means in the vicinity of the opposite ends thereof.

As the roller rotates, its outer periphery acts to lift a quantity of solvent from the tank so as to form beads between the heat-developable photosensitive medium or image receiving medium. It is thereby possible to apply the solvent to the surface to be exposed in correspondence with the movement of the heat-developable photosensitive medium.

In this arrangement, a part of the solvent is made to stay in grooves formed on the roller means, thereby preventing the solvent from being moved inward to an intermediate portion in the longitudinal direction of the roller means. It is therefore possible to uniformly attach a quantity of solvent lifted from the tank over the outer periphery of the roller means including its two ends, thereby optimizing the application of the solvent.

The image recording apparatus in accordance with the present invention may be arranged by separately providing a heat-developing section in which the heat-developable photosensitive medium which has been exposed is heat-developed and a transfer section in which the photosensitive medium is heat-developed and the image receiving medium are heated while being superposed on each other so as to transfer the image to the image receiving medium. The apparatus may be otherwise arranged such that the heat-developing section and the transfer section are disposed in the same place, that is, a heat-developing/transfer section is provided in which the heat-developable photosensitive medium which has been exposed and the image receiving medium are superposed on each other and are thereafter heated, thereby simultaneously performing heat developing and heat transfer.

The image forming apparatus in accordance with the present invention is capable of making use of heat-developable photosensitive media (heat-developable photosensitive elements) and image receiving media (coloring matter fixing elements) such as those specified in U.S. Pat. Nos. 4,304,415; 4,483,914; 4,500,626; and 4,503,137, Japanese Patent Laid-Open Nos. 154,445/1984; 165,054/1984; 180548/1985; 218443/1984; 120356/1985; and the Japanese Patent Application Nos. 209563/1984 (Laid-Open Patent Application No. 88256/1986); and 79709/1985 (Laid-Open Patent Application No. 238056/1986).

Examples of the image forming solvent in accordance with the present invention, which is needed for the formation of an image, are water, low-boiling-point organic solvents (alcohols, ketones, amides and so forth) and solvents prepared by adding various additives such as surface active agents, development promoting agents and development terminating agents to the former.

DESCRIPTION OF THE PREFERRED EMBODIMENT

An image recording apparatus in accordance with the present invention will be described below by way of an example thereof in which heat developing and heat transfer are performed simultaneously.

Figure 2:
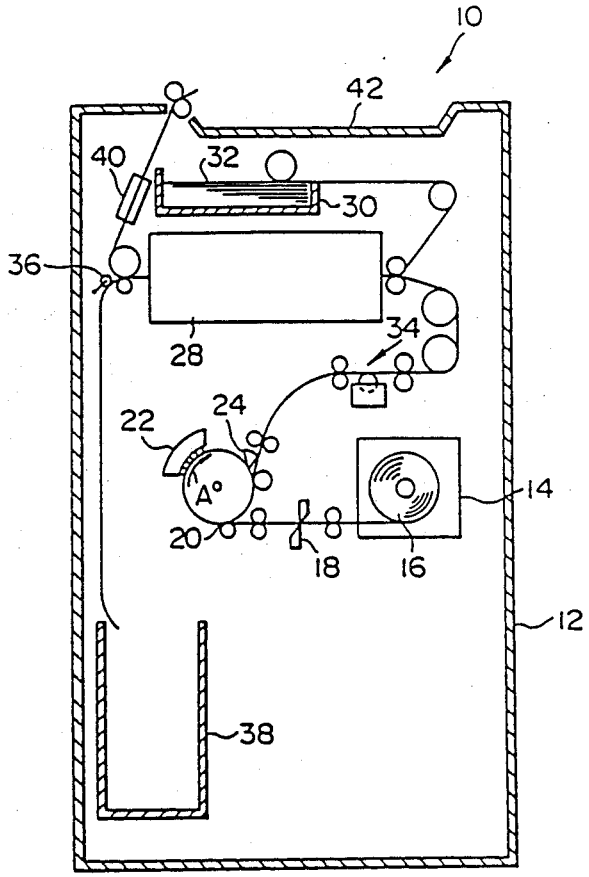
FIG. 2 is a cross-sectional view of an image recording apparatus to which the water applying section shown in FIG. 1 is applied.

FIG. 2 shows an image recording apparatus 10 in accordance with an embodiment of the present invention.

In this image forming apparatus 10, a magazine 14 which accommodates a heat-developable photosensitive medium 16 is mounted on a base 12. The heat-developable photosensitive medium 16 is drawn out at its outer periphery, cut by a cutter 18 into pieces of a predetermined length and thereafter wound around the outer circumference of an exposure drum 20 (in the direction indicated by the arrow A in FIG. 2). An exposure head 22 faces the outer periphery of the exposure drum 20. The exposure drum 20 reversely rotates after exposure, and the photosensitive medium 16 comes off by the operation of a scraper 24 and then is transported to a development/transfer section 28 after passing through a water applying section 34.

On the other hand, a sheet of image receiving paper accommodated in a tray 30 is transported to the development/transfer section 28, superposed on the photosensitive medium 16 and thereafter heated by a heater disposed in the development/transfer section 28. The photosensitive medium 16 is thereby developed and, at the same time, a developed image is transferred to the image receiving paper 32.

After the transfer operation has been completed, the photosensitive medium 16 is accommodated in a disposal tray 38 after being transported by way of a separating section 36, and the image receiving paper 32 is transported to an outlet tray 42 after passing through a drying section 40.

Figure 1:
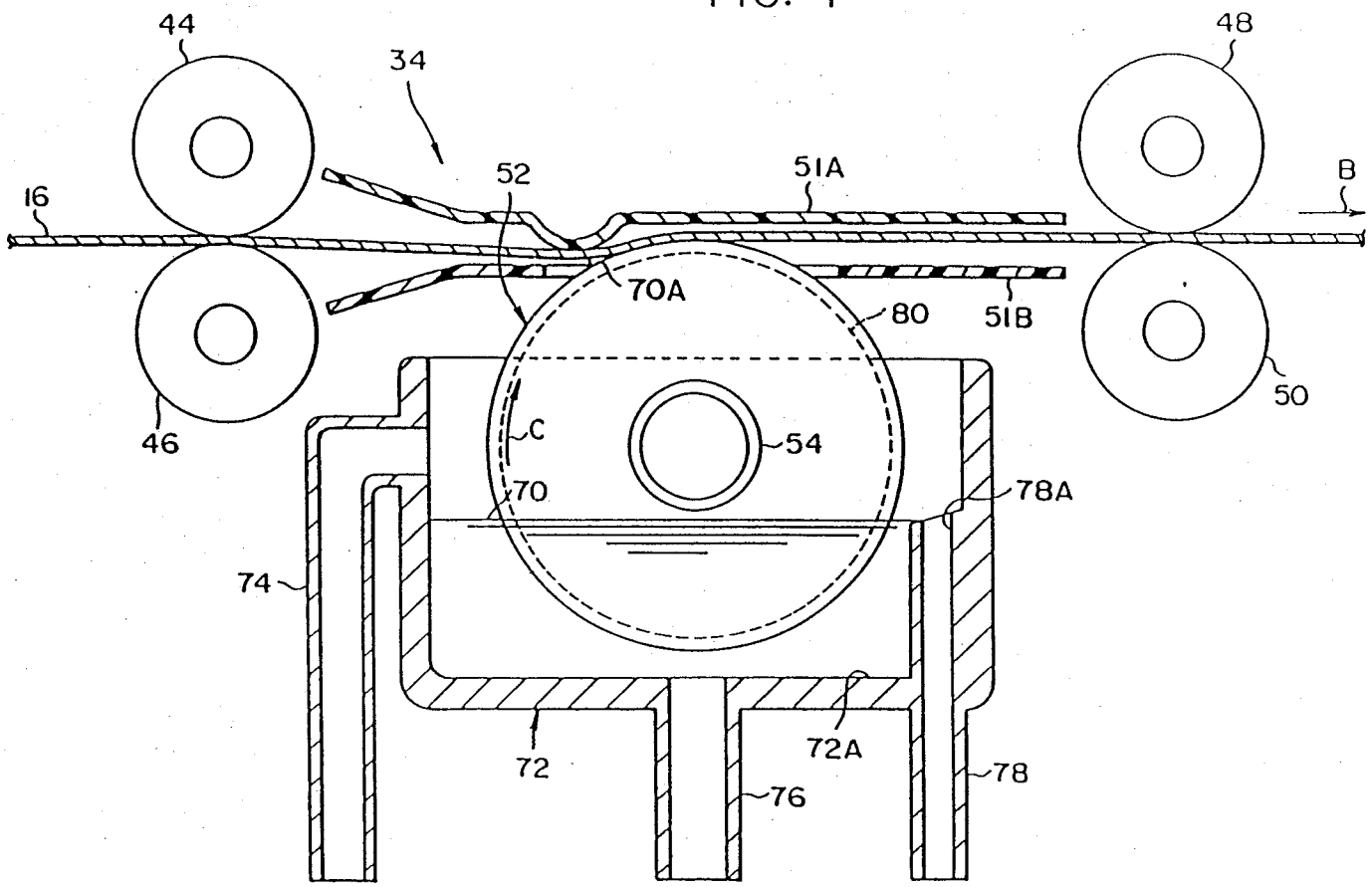
FIG. 1 is a cross-sectional view of a water applying section in accordance with an embodiment of the present invention in which the state of this section when application of water is started is illustrated.

As shown in FIG. 1, a pair of carrying rollers 44 and 46 which pinch the photosensitive medium 16 which is being transported are disposed in the water applying section 34, and a pair of carrying rollers 48 and 50 which pinch and carry the photosensitive medium 16 are disposed downstream relative to the carrying rollers 44 and 46.

These rollers are arranged such that they supply the photosensitive medium 16 to the heat development/-transfer section 28 in the direction indicated by the arrow B when they receive the driving force of a motor (not shown). Guide plates 51A and 51B are disposed between these pairs of carrying rollers such that they face the side edges of the photosensitive medium 16 which is being transported. The photosensitive medium 16 is thereby guided from the nip between the carrying rollers 44 and 46 to that between the carrying rollers 48 and 50.

An application roller 52 or an application member faces the reverse surface (the side on which the image is developed) of the photosensitive medium 16 at the center of the distance between the carrying rollers 46 and 50. The application roller 52 is axially supported at its axis 54 on the base 12 (see FIG. 2).

The application roller 52 is partly immersed in water 70 which is provided as an image forming solvent and which fills a tank 72. When the application roller 52 rotates, it lifts water 70 by its peripheral surface so as to apply water to the reverse surface of the photosensitive medium 16. When the photosensitive medium 16 is advanced, the application roller 52 is rotated by a driving means such as a motor in the direction indicated by the arrow C so as to lift water 70 by its outer peripheral surface, thereby forming a bead portion 70A on the reverse surface of the photosensitive medium 16.

A supply pipe 74 for supplying water 70 and a discharge pipe 76 for discharging water 70 in the tank 72 are attached to the tank 72 which is filled with water 70. These pipes are connected to a pump (not shown). Water in the tank 72 can be circulated or changed as desired by the drive of this pump.

Also an overflow pipe 78 is attached to the tank 72. A surplus part of the water 70 filling the tank 72 is discharged via the overflow pipe 78. The opening 78A of the overflow pipe 78 is positioned at a predetermined height from a bottom 72A of the tank 72, so that, if the water 70 which is supplied via the supply pipe 74 exceeds the height of the opening 78A, the water 70 is discharged to the outside of the tank 72 so as to maintain the quantity of water in the tank 72 (the height of the surface of the water). The height of the surface of the water may preferably be determined such that about one third of the application roller 52 is immersed.

Figure 3:
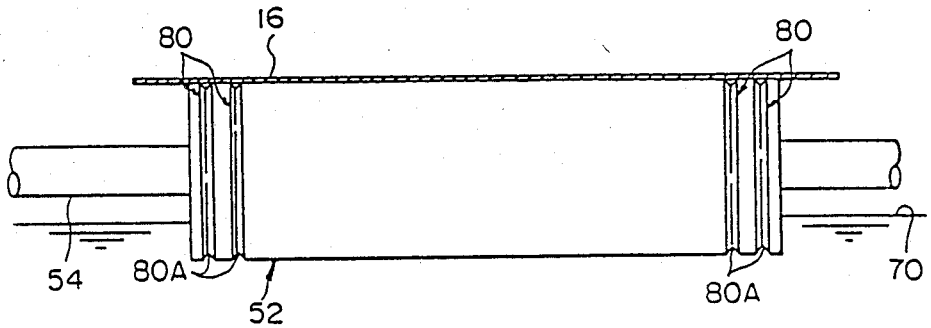
FIG. 3 is a side view of an application roller.

As shown in FIG. 3, two grooves 80 are formed on the outer periphery of the application roller 52 in the vicinity of each of the opposite ends thereof. Each groove 80 has a generally V-shaped cross section.

Each groove 80 guides a part of the water 70 lifted by the rotation of the application roller 52 into its bottom 80A so as to prevent this part of the water 70 from moving toward an intermediate portion of the application roller 52 by the effect of a surface tension which acts on the surface of the application roller 52.

The operation of this embodiment will now be described below.

The photosensitive medium 16 is wound around the exposure drum 20, exposed by the exposure head 22 and thereafter transported to the water applying section 34.

The application roller 52 takes out the water 70 in the tank 72 by attaching this water to its surface so as to form a bead 70A between itself and the reverse surface of the photosensitive medium 16. The bead 70A is thereby applied to the reverse surface of the photosensitive medium 16.

At this time, a part of the water 70 which reaches the outer peripheral surface of the application roller 52 when the application roller 52 rotates is guided into and is retained in the bottoms 80A of the grooves 80 which are formed at the opposite ends of the application roller 52.

Therefore, the embodiment thus constituted in which a part of the water 70 is retained in the grooves 80 ensures that water 70 can be positively applied even to the opposite ends of the photosensitive medium 16, thereby enabling uniform application of water to the photosensitive medium 16.

Since only a desired quantity of water stays in the grooves 80, there is no risk of an excessive quantity of water being applied, which might pass around the photosensitive medium 16 to the reverse surface thereof, and the thickness of a layer of applied water is uniform.

The photosensitive medium 16 to which water has been applied in the water applying section 34 is transported to the development/transfer section 28. A heat-developable image receiving paper 32 taken out of the tray 30 is transported to the development/transfer section 28 and is superposed on the photosensitive medium 16. In this development/transfer section, a coloring-matter image which has been formed at the same time the heat development is performed in the presence of water is heat-transferred to the image-transfer surface of the image receiving paper 32. In this state of transfer, a desired quantity of water has already been applied to the photosensitive medium 16 in a suitable manner, thereby enabling a greatly improved transfer operation.

The photosensitive medium 16 and the image receiving medium 32 in close contact with each other are transported from the development/transfer section 28 to the separating section 36. The photosensitive medium 16 is then accommodated in a stacking device 38, and the image receiving paper 32 is transported to the outlet section 40, thereafter being taken out.

In accordance with the present invention, no surplus quantity of water is applied to the image receiving paper 32, and there is therefore no possibility of contamination of the guide rollers which supply the image receiving paper 32 and the heat-developable photosensitive medium 16 to the outlet section 40 or the stacking section 38.

In the above-described embodiment, two grooves 80 are formed on the outer periphery of the application roller 52 at each of the opposite ends thereof, but the number of the grooves may be changed in accordance with the quantity of water 70 to be retained. Also each groove 80 may have any shape so long as it can retain the water 70.

The above-described embodiment has exemplified the case in which water is applied to the photosensitive medium 16 in the manner in accordance with the present invention. However, the present invention is also applicable, in a similar manner, to an arrangement in which water is applied to the image receiving paper 32.

As described above, the present invention provides an image recording apparatus which forms an image on an image receiving medium by transferring an image recorded on a heat-developable photosensitive medium in the presence of an image forming solvent, the apparatus having: a tank for storing the solvent; and an application roller disposed in the tank and adapted for applying the solvent to the heat-developable photosensitive medium or the image receiving medium by rotating in correspondence with the movement of the heat-developable photosensitive medium or the image receiving medium, the application roller having grooves formed on the outer periphery at its opposite ends. It is therefore possible to realize uniform attachment of the image forming solvent to the outer periphery of the application roller, thereby enabling uniform application of the solvent to the heat-developable photosensitive medium or the image receiving medium. The present invention is thus highly advantageous.

What is claimed is:

1. An image recording apparatus which forms an image on an image receiving medium by transferring an image recorded on a heat-developable photosensitive medium in the presence of an image forming solvent, said apparatus comprising:

a tank for storing said solvent;

roller means disposed in said tank for applying said solvent to said heat-developable photosensitive medium or said image receiving medium by rotating in correspondence with the movement of said heat-developable photosensitive medium or said image receiving medium; and retaining means for making a part of said solvent stay on said roller, said retaining means being provided only on the outer peripheries of portions of said roller means in the vicinity of the opposite ends thereof.

2. An image recording apparatus according to claim 1, wherein said retaining means is at least one groove formed in said roller means so as to extend in the circumferential direction thereof.

3. An image recording apparatus according to claim 2, wherein said groove has a generally V-shaped cross section.

4. An image recording apparatus according to claim 3, wherein said groove is formed in two places in the vicinity of each of said opposite ends.

5. An image recording apparatus which forms an image on an image receiving medium by transferring an image recorded on a heat-developable photosensitive medium in the presence of an image forming solvent, said apparatus comprising:

a tank for storing said solvent;

roller means disposed in said tank for applying said solvent to said heat-developable photosensitive medium or said image receiving medium by contacting one of said media while being rotated and partly immersed in said solvent stored in said tank; and retaining means for making a part of said solvent stay on said roller, said retaining means being proveded only on the outer peripheries of portions of said roller means in the vicinity of the opposite ends thereof.

6. An image recording apparatus according to claim 5, wherein said retaining means is at least one groove formed in said roller means so as to extend in the circumferential direction thereof.

7. An image recording apparatus according to claim 6, wherein said groove has a generally V-shaped cross section.

8. An image recording apparatus according to claim 7, wherein said groove is formed in two places in the vicinity of each of said opposite ends.

* * * * *